US008215996B2

(12) United States Patent
Su et al.

(10) Patent No.: US 8,215,996 B2
(45) Date of Patent: Jul. 10, 2012

(54) ELECTRICAL CONNECTOR

(75) Inventors: Yu-Hung Su, Tu-Cheng (TW); Yao-Ting Wang, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 180 days.

(21) Appl. No.: 12/841,835

(22) Filed: Jul. 22, 2010

(65) Prior Publication Data

US 2012/0021646 A1 Jan. 26, 2012

(51) Int. Cl.
*H01R 24/00* (2006.01)

(52) U.S. Cl. ..... 439/660

(58) Field of Classification Search ..... 439/660, 439/78, 80

See application file for complete search history.

(56) References Cited

U.S. PATENT DOCUMENTS 7,150,651 B1 * 12/2006 Yuan et al. ..... 439/607.54
7,223,108 B2 * 5/2007 Chiang et al. ..... 439/137
7,288,006 B2 * 10/2007 Su et al. ..... 439/638
7,517,253 B1 * 4/2009 Chiang ..... 439/660
7,534,143 B1 * 5/2009 Tsao et al. ..... 439/607.41
7,572,146 B1 * 8/2009 Chiang ..... 439/607.01
7,604,512 B1 * 10/2009 Chen ..... 439/660
7,611,387 B1 * 11/2009 Zhang ..... 439/660
7,618,293 B2 * 11/2009 Wu ..... 439/660
7,641,519 B1 * 1/2010 Chen ..... 439/660
7,686,656 B2 * 3/2010 Zheng et al. ..... 439/660
7,695,318 B1 * 4/2010 Wang et al. ..... 439/607.01
7,785,152 B2 * 8/2010 Yi et al. ..... 439/660
7,794,284 B1 * 9/2010 He et al. ..... 439/660
7,806,735 B1 * 10/2010 Chen et al. ..... 439/676
7,833,065 B2 * 11/2010 Lin et al. ..... 439/639
7,862,346 B1 * 1/2011 Wan et al. ..... 439/79
7,862,378 B1 * 1/2011 Wan et al. ..... 439/607.35
7,887,370 B2 * 2/2011 Chen et al. ..... 439/607.35
7,909,653 B1 * 3/2011 Wan et al. ..... 439/660
7,938,659 B1 * 5/2011 Zhu et al. ..... 439/218
7,942,704 B2 * 5/2011 Ko et al. ..... 439/660
7,959,450 B1 * 6/2011 Wang et al. ..... 439/135
7,988,499 B2 * 8/2011 Lin et al. ..... 439/701
8,021,195 B2 * 9/2011 He et al. ..... 439/638
8,038,474 B2 * 10/2011 Ju ..... 439/607.01
8,079,879 B2 * 12/2011 Chiang ..... 439/660
8,083,546 B2 * 12/2011 Lee ..... 439/607.02
8,100,724 B2 * 1/2012 Lin et al. ..... 439/630
8,109,795 B2 * 2/2012 Lin et al. ..... 439/660
8,123,558 B2 * 2/2012 Su et al. ..... 439/607.01
8,133,078 B2 * 3/2012 Lin et al. ..... 439/660
8,133,079 B2 * 3/2012 He ..... 439/660

(Continued)

*Primary Examiner* — Neil Abrams
(74) *Attorney, Agent, or Firm* — Cheng-Ju Chiang

(57) ABSTRACT

An electrical connector includes a first insulating body having a base board and a tongue board extending rearward from the base board, and a second insulating body having a base portion and fingers extending forward from the base portion. Two opposite sides of the tongue board protrude upward to form two clipping walls and oppositely protrude outward to form two restraining portions spaced from the clipping walls. A receiving space is formed among the tongue board, the base board and the clipping walls for receiving the second insulating body therein. The base portion is clipped between the clipping walls. Front ends of the fingers prop against the base board. Each side surface of the base portion defines an elastic arm having a top connected with the side surface and a bottom beyond a bottom surface of the base portion to be restrained between the restraining portion and the clipping wall.

10 Claims, 4 Drawing Sheets

U.S. PATENT DOCUMENTS

2010/0159751 A1* 6/2010 Chiu et al. ..... 439/660
2011/0009008 A1* 1/2011 Wang ..... 439/660
2012/0015561 A1* 1/2012 Tsai ..... 439/660
2012/0021646 A1* 1/2012 Su et al. ..... 439/607.01
2012/0052709 A1* 3/2012 Ko ..... 439/345
2012/0052739 A1* 3/2012 Wang et al. ..... 439/660

* cited by examiner

ELECTRICAL CONNECTOR

BACKGROUND OF THE INVENTION

1. Field of the Invention

The present invention relates to an electrical connector, and more particularly to an electrical connector having high signal transmission rate.

2. The Related Art

With the development of electronic technology, electronic products need to be miniaturized and have high signal transmission rate. Conventionally, in order to have a high signal transmission rate, two or more traditional electrical connectors are pieced together. However, the pieced electrical connector often occupies a relatively large space so that cannot meet the requirement of miniaturization. Furthermore, the process of piecing together the traditional electrical connectors often needs to take a great quantity of manpower and material resources so that results in too high manufacture cost and lower productivity.

SUMMARY OF THE INVENTION

It is an object of the present invention to provide an electrical connector which includes a first insulating body, a plurality of first terminals disposed in the first insulating body respectively and spaced from one another along a transverse direction of the first insulating body, a second insulating body, and a plurality of second terminals disposed in the second insulating body respectively and spaced from one another along the transverse direction of the base portion. The first insulating body has a base board and a tongue board extending rearward from a bottom of the base board. Two opposite sides of the tongue board protrude upward to form a pair of clipping walls and oppositely protrude outward to form two restraining portions spaced from the corresponding clipping walls. A receiving space is formed among the tongue board, the base board and the pair of clipping walls. Each of the first terminals has a first contact portion disposed in the base board and projecting beyond a top surface of the base board. The second insulating body is received in the receiving space of the first insulating body. The second insulating body has a base portion clipped between the clipping walls, and a plurality of fingers extending forward from a bottom of the base portion and spaced from one another along a transverse direction of the base portion. Front ends of the fingers prop against a rear end of the base board. Two opposite side surfaces of the base portion are provided with a pair of elastic arms each having a top connected with the side surface, and a bottom extending beyond a bottom surface of the base portion. The elastic arm is restrained between the restraining portion and the corresponding clipping wall. Each of the second terminals has a second contact portion stretching out of a front of the base portion and projecting beyond a top of the finger. Each of the second contact portions is capable of being pressed downward between adjacent two of the fingers.

As described above, in the process of assembling the electrical connector of the present invention, the second insulating body can be easily assembled to the first insulating body by means of the cooperation of the restraining portion, the clipping wall and the elastic arm, so that economizes a great quantity of manpower and material resources, reduces manufacture cost of the electrical connector, and further increases productivity of the electrical connector. Moreover, the electrical connector of the present invention can meet the requirements of miniaturization and high signal transmission rate.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 2:
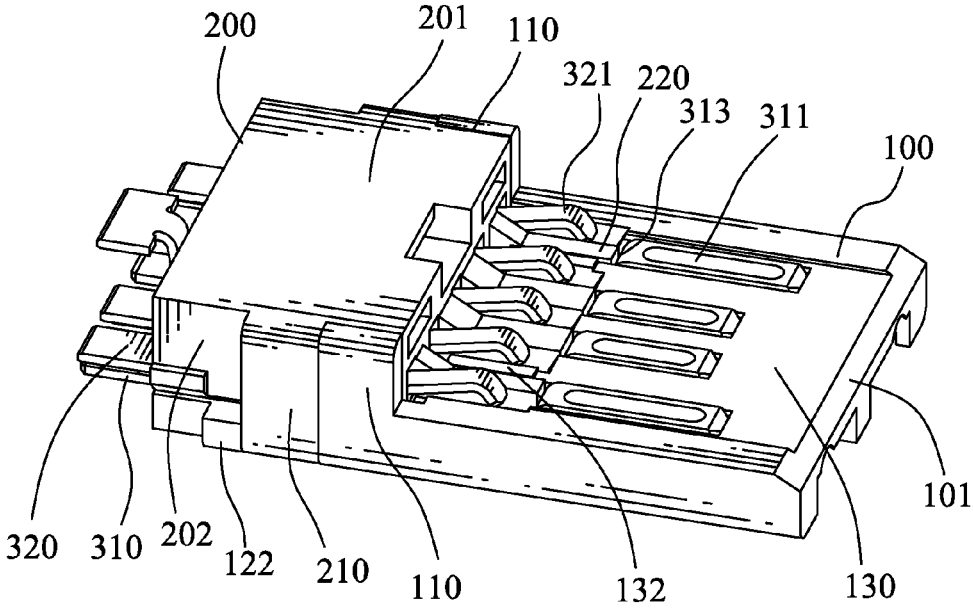
FIG. 2 is a perspective view of the electrical connector of FIG. 1 except a shielding shell.
Figure 3:
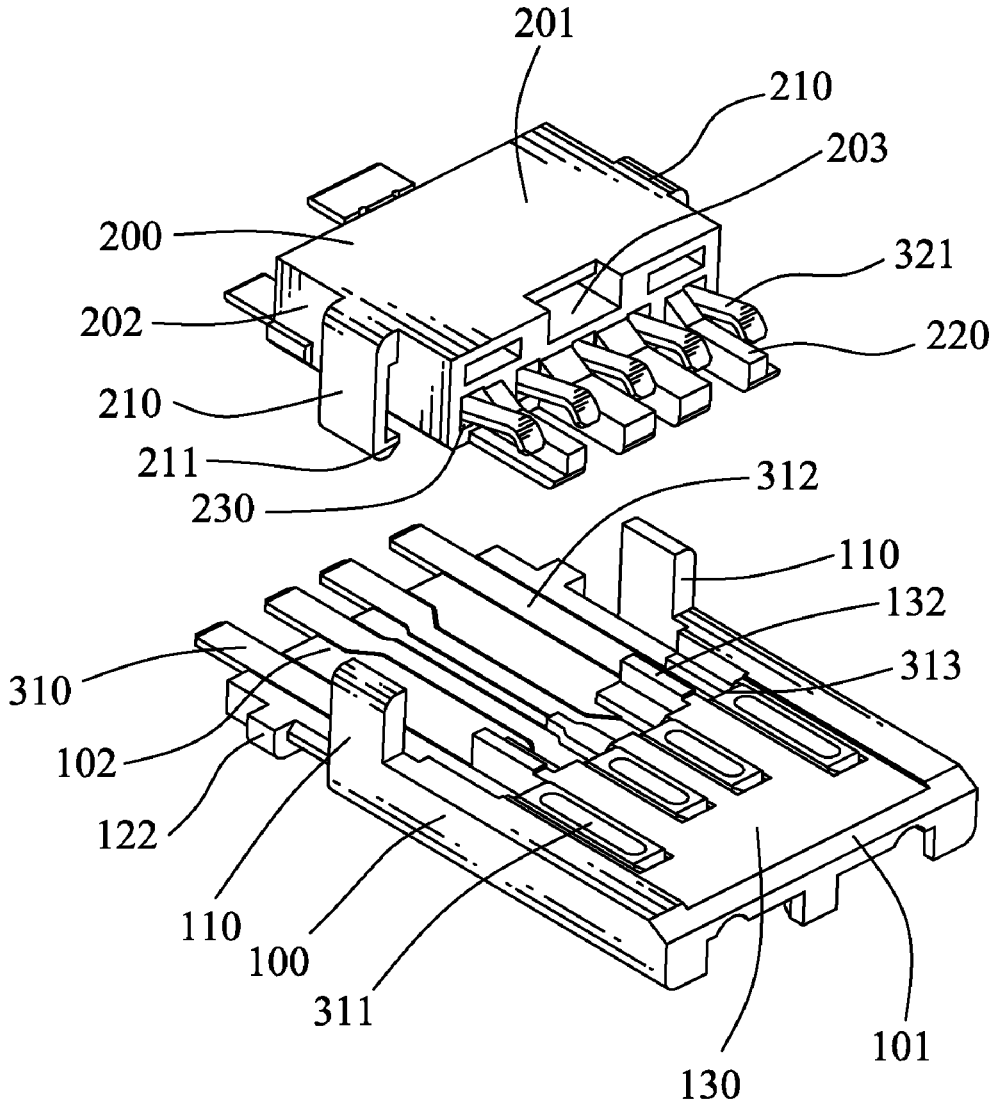
FIG. 3 is a summary exploded view of the electrical connector without the shielding shell of FIG. 2.

Referring to FIG. 2 and FIG. 3, an electrical connector according to the present invention includes a first insulating body 100, a second insulating body 200 mounted to the first insulating body 100, a plurality of first terminals 310 disposed in the first insulating body 100, and a plurality of second terminals 320 disposed in the second insulating body 200.

Figure 4:
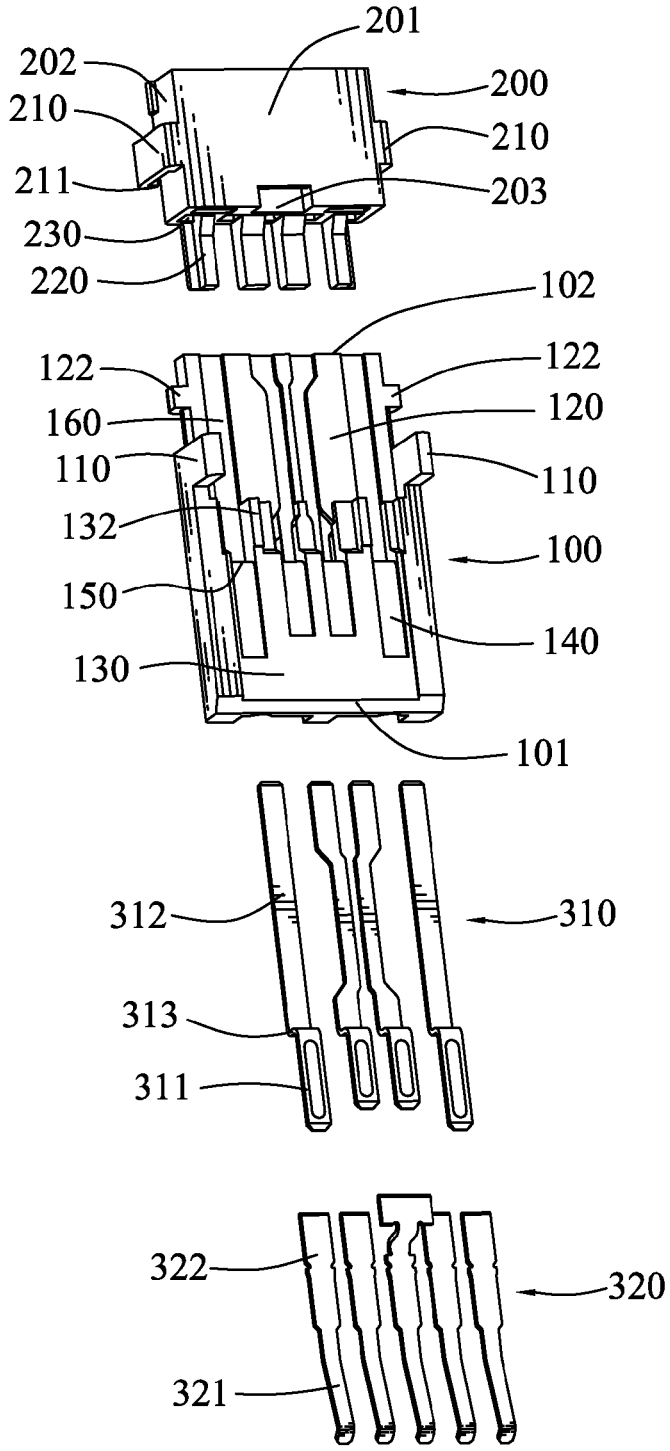
FIG. 4 is a detailed exploded view of the electrical connector without the shielding shell of FIG. 2.
Figure 5:
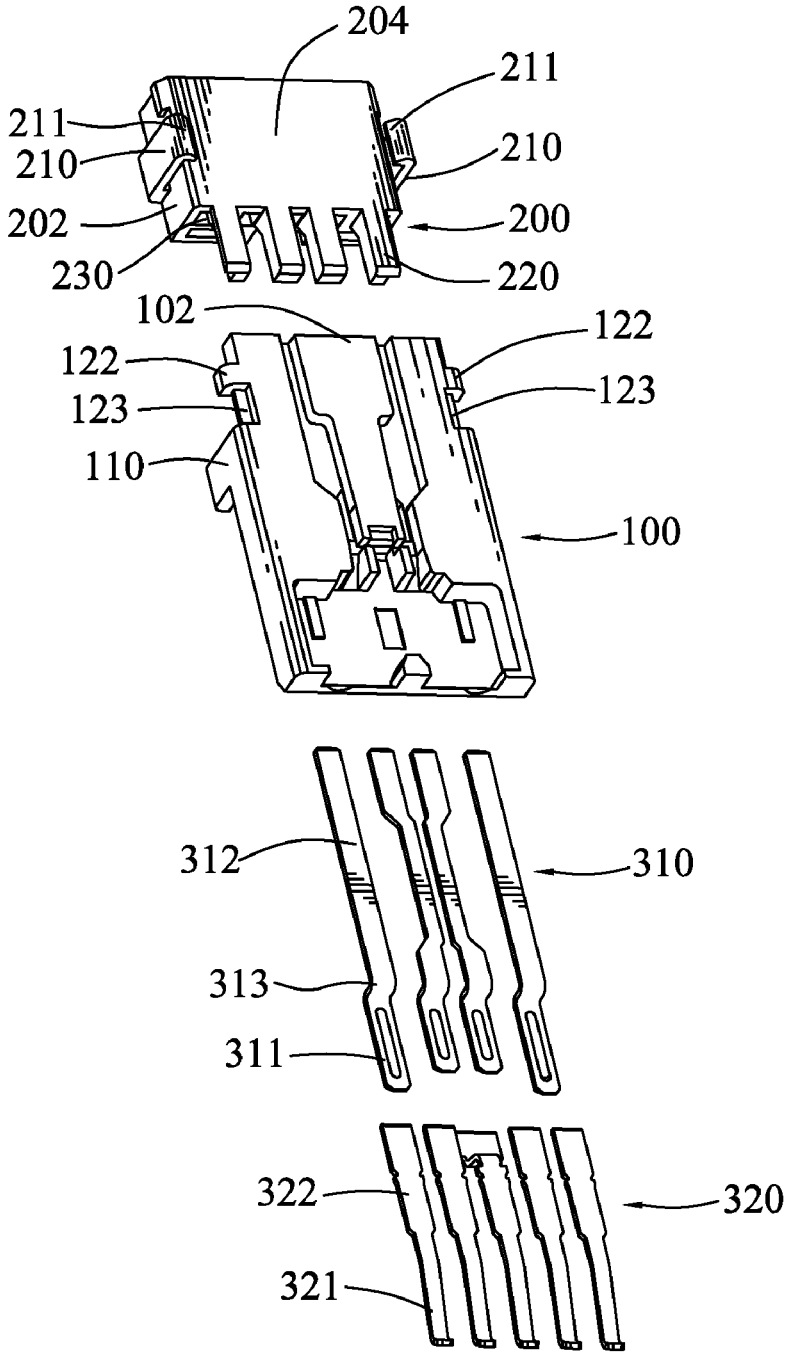
FIG. 5 is another angle of detailed exploded view of the electrical connector without the shielding shell of FIG. 2.

Referring to FIG. 3, FIG. 4 and FIG. 5, the first insulating body 100 has a rectangular base board 101 disposed levelly, and a rectangular tongue board 102 which is formed by the base board 101 stretching rearward from a bottom of a rear end thereof. Substantial middle portions of two opposite side edges of the tongue board 102 protrude upward beyond a top surface 130 of the base board 101 to form a pair of clipping walls 110. Accordingly, a receiving space 120 is formed among the tongue board 102, the rear end of the base board 101 and the pair of clipping walls 110. Rear portions of the two opposite side edges of the tongue board 102 oppositely protrude outward to form two restraining portions 122, of which each is located behind and spaced from the corresponding clipping wall 110. A buckling gap 123 is opened at a lower portion of each side edge of the tongue board 102 and between the restraining portion 122 and the clipping wall 110, without communicating with the receiving space 120. A top of the tongue board 102 defines a plurality of fastening cavities 160 communicating with the receiving space 120 and arranged at regular intervals along a transverse direction thereof. Each of the fastening cavities 160 extends longitudinally to penetrating through the tongue board 102. The top surface 130 of the base board 101 defines a plurality of receiving cavities 140 one-on-one corresponding to the fastening cavities 160, and each extending longitudinally to be connected with a front end of one of the fastening cavities 160 by means of a connecting passage 150 opened at the rear end of the base board 101. The rear end of the base board 101 protrudes rearward into the receiving space 120 to form a plurality of restraining blocks 132 each located between two adjacent fastening cavities 160.

Each of the first terminals 310 has a fastening strip 312 and a first contact portion 311 which is connected with one end of the fastening strip 312 in a step manner by a connecting portion 313. The fastening strips 312 are secured in the fastening cavities 160 of the first insulating body 100 respectively, the first contact portions 311 are disposed in the corresponding receiving cavities 140 and project beyond the top surface 130 of the base board 101, and the connecting portions 313 are restrained in the corresponding connecting passages 150. In this embodiment, in order to achieve a firmer engagement between the first terminals 310 and the first insulating body 100, the fastening strip 312 may be designed with a crooked shape, and accordingly, the corresponding fastening cavity 160 is altered to match with the fastening strip 312 of the crooked shape.

Referring to FIG. 3, FIG. 4 and FIG. 5 again, the second insulating body 200 has a rectangular base portion 201 of which a front of a bottom protrudes forward to form a plurality of fingers 220 spaced from one another along a transverse direction of the base portion 201. A buckling fillister 203 is opened in a top of the base portion 201. The base portion 201 defines a plurality of fastening passageways 230 arranged at regular intervals along the transverse direction thereof and each extending longitudinally to penetrate through the base portion 201 between adjacent two fingers 220. Two opposite side surfaces 202 of the base portion 201 are provided with a pair of elastic arms 210 each having a top connected with a substantial middle of a top of the side surface 202, and a bottom extending beyond a bottom surface 204 of the base portion 201. Two bottoms of the pair of elastic arms 210 protrude towards each other to form a pair of buckling barbs 211.

Each of the second terminals 320 has a fastening slice 322 and a second contact portion 321 which is connected with one end of the fastening slice 322 and slanted beyond a plane of the fastening slice 322. The fastening slices 322 are secured in the fastening passageways 230 of the second insulating body 200 respectively. The second contact portions 321 stretch out of the front of the base portion 201 and each can be pressed downward between corresponding two of the fingers 220, when the second contact portions 321 electrically connect with a mating connector.

Referring to FIG. 2 and FIG. 3 again, when the second insulating body 200 with the second terminals 320 is assembled to the first insulating body 100 with the first terminals 310, the second insulating body 200 is received in the receiving space 120 of the first insulating body 100. The base portion 201 is clipped between the clipping walls 110, the elastic arm 210 is restrained between the restraining portion 122 and the corresponding clipping wall 110, and the buckling barb 211 is buckled in the corresponding buckling gap 123, so that make the second insulating body 200 firmly engaged with the first insulating body 100. The bottom surface 204 of the base portion 201 of the second insulating body 200 abuts against the top of the tongue board 102 of the first insulating body 100 so as to further restrain the fastening strips 312 of the first terminals 310 in the fastening cavities 160. Front ends of the fingers 220 prop against the connecting portions 313 of the first terminals 310 respectively to restrain the connecting portions 313 in the respective connecting passages 150, so that further ensures the first terminals 310 firmly assembled in the first insulating body 100. The restraining block 132 is received between adjacent two of the fingers 220 for restraining the corresponding second contact portion 321 from swaying by means of the cooperation of the restraining block 132 and the corresponding finger 220, when the second contact portions 321 electrically connect with the mating connector.

Figure 1:
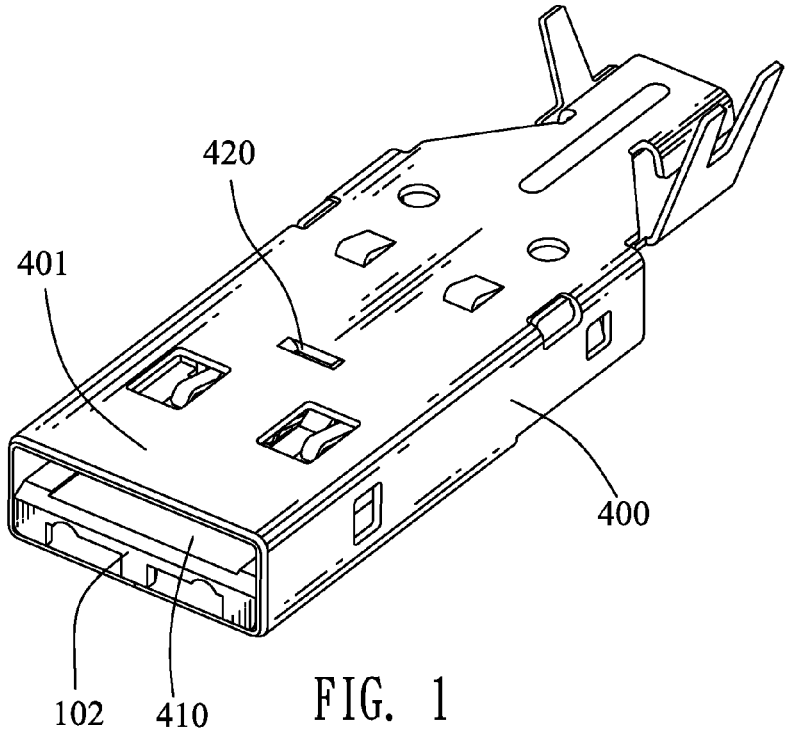
FIG. 1 is a perspective view of an electrical connector in accordance with the present invention.

Referring to FIG. 1, the electrical connector further includes a rectangular hollow shielding shell 400 enclosing the first insulating body 100 and the second insulating body 200, with an inserting space 410 being formed among a top plate 401 of the shielding shell 400, the tongue board 102 and the fingers 220. A locking barb 420 is provided at an inside of the top plate 401 and buckled in the buckling fillister 203 of the second insulating body 200 to make the shielding shell 400 firmly secured around the insulating bodies 100, 200. The shielding shell 400 not only can protect the insulating bodies 100, 200 and the terminals 310, 320 from harm, but also can shield the terminals 310, 320 from static electricity.

As described above, in the process of assembling the electrical connector of the present invention, the second insulating body 200 can be easily assembled to the first insulating body 100 by means of the cooperation of the restraining portion 122, the clipping wall 110 and the elastic arm 210, and the buckle of the buckling barb 211 and the buckling gap 123, so that economizes a great quantity of manpower and material resources, reduces manufacture cost of the electrical connector, and further increases productivity of the electrical connector. Moreover, the electrical connector of the present invention can meet the requirements of miniaturization and high signal transmission rate.

What is claimed is:

1. An electrical connector, comprising:

a first insulating body having a base board and a tongue board extending rearward from a bottom of the base board, two opposite sides of the tongue board protruding upward to form a pair of clipping walls and oppositely protruding outward to form two restraining portions spaced from the corresponding clipping walls, a receiving space being formed among the tongue board, the base board and the pair of clipping walls;

a plurality of first terminals disposed in the first insulating body respectively and spaced from one another along a transverse direction of the first insulating body, each of the first terminals having a first contact portion disposed in the base board and projecting beyond a top surface of the base board;

a second insulating body received in the receiving space of the first insulating body, the second insulating body having a base portion clipped between the clipping walls, and a plurality of fingers extending forward from a bottom of the base portion and spaced from one another along a transverse direction of the base portion, front ends of the fingers propping against a rear end of the base board, two opposite side surfaces of the base portion being provided with a pair of elastic arms each having a top connected with the side surface, and a bottom extending beyond a bottom surface of the base portion, the elastic arm being restrained between the restraining portion and the corresponding clipping wall; and a plurality of second terminals disposed in the second insulating body respectively and spaced from one another along the transverse direction of the base portion, each of the second terminals having a second contact portion stretching out of a front of the base portion and projecting beyond a top of the finger, each of the second contact portions being capable of being pressed downward between adjacent two of the fingers.

2. The electrical connector as claimed in claim 1, wherein a buckling gap is opened at a lower portion of each side edge of the tongue board and between the restraining portion and the clipping wall, two bottoms of the pair of elastic arms protrude towards each other to form a pair of buckling barbs buckled in the corresponding buckling gaps.

3. The electrical connector as claimed in claim 1, wherein the rear end of the base board protrudes rearward into the receiving space to form a plurality of restraining blocks each located between adjacent two of the fingers so as to restrain the second contact portion of the corresponding second terminal from swaying by means of the cooperation of the restraining block and the corresponding finger.

4. The electrical connector as claimed in claim 1, wherein the first terminal further has a fastening strip connected with the first contact portion in a step manner by a connecting portion, the fastening strip is secured in the tongue board of the first insulating body, and the connecting portion is disposed in the rear end of the base board.

5. The electrical connector as claimed in claim 4, wherein a top of the tongue board defines a plurality of fastening cavities communicating with the receiving space, the top surface of the base board defines a plurality of receiving cavities each connected with a front end of one of the fastening cavities by means of a connecting passage opened at the rear end of the base board, the fastening strip is secured in the fastening cavity, the first contact portion is disposed in the receiving cavity, and the connecting portion is restrained in the connecting passage, a bottom surface of the base portion of the second insulating body abuts against the top of the tongue board to further restrain the fastening strips of the first terminals in the fastening cavities, the front ends of the fingers prop against the connecting portions of the first terminals respectively to further restrain the connecting portions in the respective connecting passages.

6. The electrical connector as claimed in claim 4, wherein the fastening strip is designed with a crooked shape.

7. The electrical connector as claimed in claim 1, wherein the second terminal further has a fastening slice connected with the second contact portion, the second contact portion is slanted beyond a plane of the fastening slice, the fastening slice is secured in the base portion.

8. The electrical connector as claimed in claim 7, wherein the base portion defines a plurality of fastening passageways each extending longitudinally to penetrating through the base portion between adjacent two fingers, the fastening slices are secured in the fastening passageways respectively.

9. The electrical connector as claimed in claim 1, further comprising a shielding shell enclosing the first insulating body and the second insulating body, with an inserting space being formed among a top plate of the shielding shell, the tongue board and the fingers.

10. The electrical connector as claimed in claim 9, wherein a buckling fillister is opened in a top of the base portion of the second insulating body, a locking barb is provided at an inside of the top plate of the shielding shell to be buckled in the buckling fillister.

* * * * *